United States Patent [19]

Nell

[11] 4,008,811

[45] Feb. 22, 1977

[54] UNCOUPLING DEVICE FOR CENTRAL BUFFER COUPLINGS ON RAILROAD VEHICLES

[75] Inventor: Kuno Nell, Zorneding, Germany

[73] Assignee: Knorr-Bremse GmbH, Munich, Germany

[22] Filed: June 18, 1975

[21] Appl. No.: 587,865

[30] Foreign Application Priority Data

June 19, 1974 Germany ..... 2429365

[52] U.S. Cl. ..... 213/211

[51] Int. Cl.[2] ..... B61G 7/04

[58] Field of Search ..... 213/75 R, 75 A, 75 TC, 213/211, 212, 218, 219

[56] References Cited

UNITED STATES PATENTS 3,682,325 8/1972 Peterson et al. ..... 213/219 X

FOREIGN PATENTS OR APPLICATIONS 2,201,709 9/1972 Germany

*Primary Examiner*—Robert B. Reeves
*Assistant Examiner*—John P. Shannon
*Attorney, Agent, or Firm*—Edmund M. Jaskiewicz

[57] ABSTRACT

An uncoupling device for a central buffer coupling on a railroad vehicle comprises an operating mechanism which has one end pivotally mounted adjacent the tracks on which the vehicle is positioned and on the other end is provided with an uncoupling hook which is engageable with the uncoupling lever pivotally mounted on the railway vehicle. The operating mechanism is moved between inoperative and engaging positions by a drive which is actuated by a switch responsive to the engaging of the uncoupling lever with the hook on the operating mechanism.

12 Claims, 5 Drawing Figures

UNCOUPLING DEVICE FOR CENTRAL BUFFER COUPLINGS ON RAILROAD VEHICLES

The present invention relates to the uncoupling of central buffer couplings on railway vehicles, more particularly, to a stationary uncoupling device.

Central buffer couplings on railroad cars are employed for connecting successive railroad cars and may be uncoupled by actuation of an uncoupling lever which is pivotally mounted on each railroad car. In order to uncouple successive railroad cars as they are moving along a track it has been proposed to provide a stationary uncoupling device having an operating lever which is mounted for pivotal movement about a substantially horizontal axis extending transversely to the longitudinal axes of the railroad cars. The operating lever generally comprises a hook or fork portion which is engageable with the uncoupling lever so as to actuate the lever to uncouple the cars.

One such uncoupling device is disclosed in the German Offenlegungsschrift No. 2,201,709 wherein the operating lever of the uncoupling device is mounted below and parallel with the rails upon which the cars are moving and positioned outside of the outline of the cars. The operating lever is connected by a crank arrangement comprising two rods to a piston which is movable substantially in a parallel direction with respect to the rails. The piston is subjected on both sides thereof to compression springs. The operating lever is retained against the action of the springs in an inoperative position in which the uncoupling lever fork mounted thereon is located approximately at the level of the rails. When a detent is released manually or through a control device the springs will move the operating lever into the uncoupling position wherein the hook which is rigidly mounted on the operating lever is located at the level of the uncoupling levers of the railroad cars on the adjacent rails. The piston is held in its central position by the two springs. As soon as the uncoupling lever on the leading railroad car of a pair of railroad cars which are to be uncoupled is engaged by the hook on the operating lever, the operating lever will be pivoted together with the uncoupling lever and against the action of the springs that load the piston. After uncoupling, the uncoupling lever slides out of the hook and the operating lever is released to pivot back into its initial position under the action of the compression springs.

Such a stationary uncoupling device has the disadvantage that the uncoupling levers on the railroad cars must be located in such a manner as to be exposed to be able to slide into the fork or hook on the operating lever. Uncoupling is not at all possible unless the railroad car uncoupling lever is exposed so as to be readily engageable by the operating lever of the stationary device. It is virtually impossible to construct the railroad car uncoupling lever in such a manner. In general, it is not at all possible to eliminate the existence of any projecting structures on railroad cars that extend to the level or boundary of the operating levers and would thus tend to cover such levers or to at least impede access thereto.

It is therefore the principal object of the present invention to provide a novel and improved stationary uncoupling device for the central buffer couplings of railroad cars.

It is another object of the present invention to provide such a stationary uncoupling device which is capable of reliable operation without risk of damage should passing coupled railroad cars have any projecting structures that may extend to the area of the operating mechanism or the hook on the operating lever when in the engaging position.

It is a further object of the present invention to provide such an uncoupling device which is capable of actuating railroad car uncoupling levers which may be located at different heights above the rails or are pivotable to different heights above the rails during the uncoupling operation.

It is an additional object of the present invention to provide such an uncoupling device which embodies a relatively simple structure but which is of sufficient strength to provide long and reliable periods of trouble-free operation.

According to one aspect of the present invention an uncoupling device for a central buffer coupling on a railroad vehicle having an uncoupling lever pivotable about a horizontal axis transverse to the longitudinal axis of the vehicle may comprise an operating mechanism mounted adjacent the rails upon which the railroad vehicle is positioned and having one end portion mounted for pivotable movement about a horizontal axis transverse to the longitudinal axis of the vehicle. The operating mechanism is pivotable between an inoperative position and an uncoupling lever engaging position. A hook or fork is pivotally mounted on the other end of the operating mechanism. The operating mechanism is moved between its inoperative and engaging positions by drive means. The drive means are actuated by switch means which are responsive to the engaging of the uncoupling lever with the hook.

The present invention thus provides a hook which is individually pivotable on the operating lever so that when the operating mechanism is in the uncoupling lever engaging position, the hook will be pivoted and return to its initial position if the hook should contact any projecting structure on the railroad car before the uncoupling lever on the car reaches the uncoupling device. After the hook returns to its initial position and intercepts the uncoupling lever on the leading railroad car, the intercepting of the lever will operate a switch to actuate a drive to move the operating mechanism from the engaging position into the uncoupling position. The drive means can also operate to return the operating mechanism into its normal or inoperative position wherein the uncoupling device is disposed outside of the clearance profile of the railroad cars. A second drive may be provided in order to move the operating mechanism from its normal or inoperative position into the position where the hook can intercept the railroad car uncoupling lever.

Other objects and advantages of the present invention will be apparent upon reference to the accompanying description when taken in conjunction with the following drawings, which are exemplary, wherein.

Proceeding next to the drawings wherein like reference symbols indicate the same parts throughout the various views a specific embodiment and modification of the present invention will be described in detail.

Figure 1:
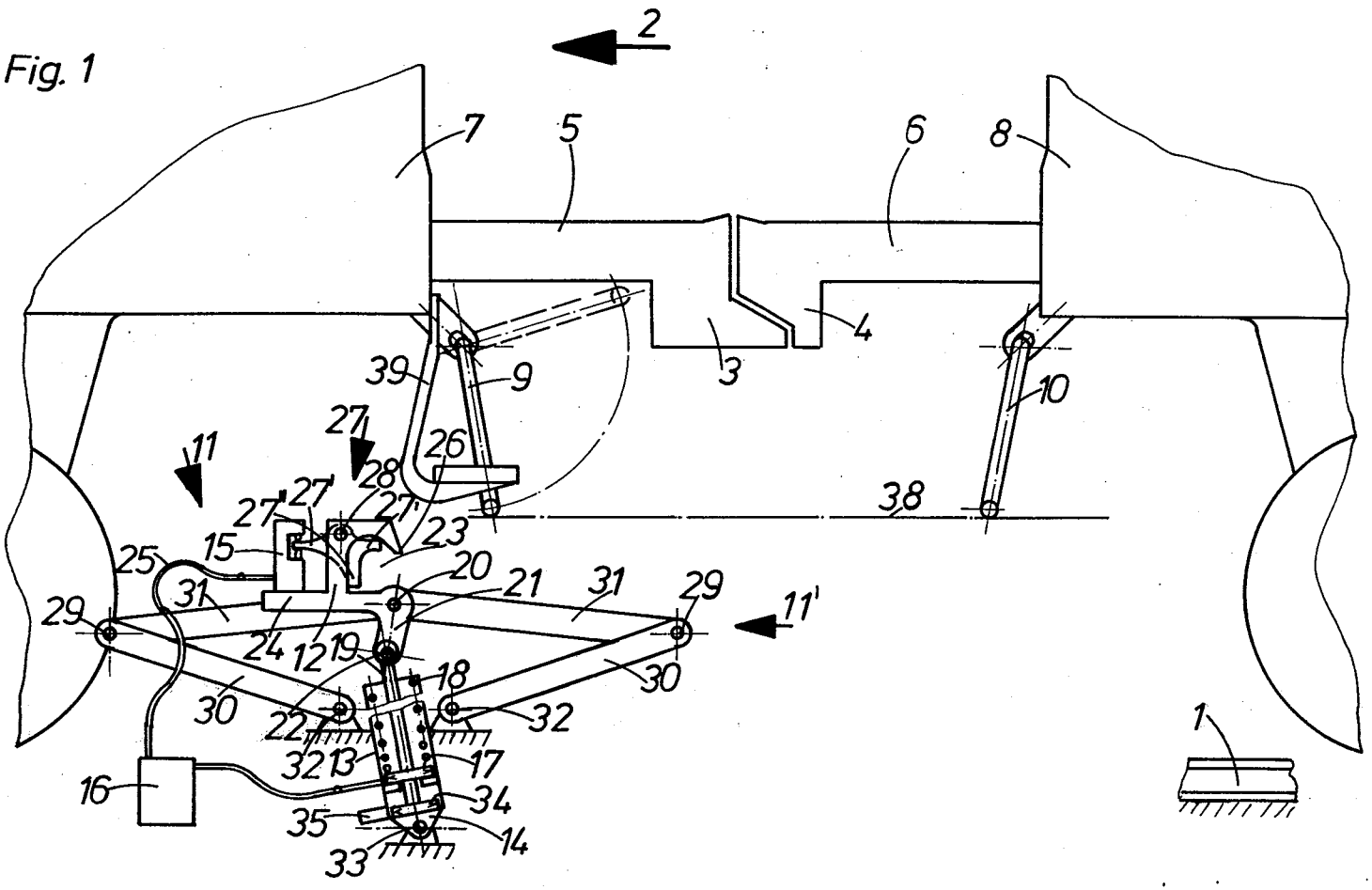
FIG. 1 is a side elevational view of an uncoupling device according to the present invention in the inoperative or normal position.

As may be seen in FIGS. 1–4, the uncoupling device according to the present invention is positioned beside a pair of rails 1, and in particular may be positioned immediately in front of the hump of a railroad yard in order to uncouple the central buffer couplings that couple together railroad cars moving in the direction indicated by the arrow 2 on the rails 1. Each central buffer coupling between the railroad cars comprises two mutually engaging reciprocally locked coupling heads 3 and 4 that are connected by means of traction or draw bars 5 and 6 to a leading railroad car 7 and a following railroad car 8, respectively. The railroad cars 7 and 8 are each provided with uncoupling levers 9 and 10 each of which is pivotable about a horizontal axis extending transversely to the direction of travel 1 or to the longitudinal axis of each of the railroad cars.

The uncoupling device according to the present invention comprises an operating mechanism indicated generally at 11 on one end portion of which is mounted an intercepting hook or fork 12, a first drive cylinder 13 and a second drive cylinder 14 both of which may be of the fluid pressure medium operated type and an electric switch 15. The first cylinder 13 is connected to a source of pressure medium 16 which may be compressed air or hydraulic fluid and the connection of this source of pressure 16 to the cylinder 13 is controlled by the switch 15. The first cylinder 13 is provided with a piston 17 loaded by a compression spring 18 so as to be in the retracted position in which a piston rod 19 is retracted as may be seen in FIG. 1.

The fork 12 is pivotally mounted on linkage 11′ of the operating mechanism 11 so as to be pivotable on its lower portion about a pin 20. Extending downwardly from the lower portion of the hook is an extension 21 which is pivotally connected to the free end of the piston rod 19 by a pin 22. The hook is provided with an opening 23 and on the side of the hook away from the opening there is an extension 24 which is constructed so as to function as an extension of the lower portion of the hook. The switch 15 is mounted on the extension 24 and is connected through a flexible tube 25 to the source of fluid pressure 16.

On the upper portion of the hook 12 there is provided a sloping projection or nose 26. A T-shaped switching lever 27 is pivotally mounted on a pin 28 on the fork 12. A switching lever 27 is provided with a pair of arms 27′ extending laterally in both directions from a stem 27″. The pivot pin 28 is located at the juncture between the side arms 27′ and the stem 27″. The arm 27′ of the switching lever 27 extending away from the hook opening 23 engages the switch 15 and the second arm 27′ and stem 27″ project into the hook opening 23 as shown in FIG. 1.

Linkage 11′ of the operating mechanism 11 comprises a pincers-type arrangement wherein a pair of links or arms 30 and 31 are pivotally interconnected at their ends by a pin 29 so as to be pivotable in relation to each other about such a pin. The lower arm 30 is pivotally mounted about a fixed pin 32 and the upper arm 31 is connected to the pivot pin 20 upon which the fork 12 is pivotally mounted. The drive cylinder 13 has its end away from the fork 12 pivotally mounted about a fixed pin 33.

The pins 20, 22, 29, 32 and 33 always extend substantially in a horizontal direction and transversely to the rails 1 and in this position are parallel with the pivot axes of the railroad car uncoupling levers 9 and 10. Thus, the linkage 11′, drive cylinder 13 and fork 12 are movable in a vertical plane which is perpendicular to the plane of the rails 1.

In the invention as described above, a second drive cylinder 14 is mounted coaxially to the first cylinder 13 and is connected to the first cylinder so that the two cylinders 13 and 14 form a drive component which is pivotally mounted about the fixed pin 33. The second cylinder 14 comprises a piston 34 which engages the piston 17 of the first cylinder 13. When a pressure medium is supplied though line 35 to the second piston 14, the piston 34 can be displaced against the action of the compression spring 18 that loads the piston 17 of the first cylinder 13.

FIGS. 1–4 illustrate the sequence of steps in an uncoupling operation according to the present invention. In the normal or inoperative position of FIG. 1, the drive cylinders 13 and 14 are not subjected to any action from a pressure medium and the pistons 17 and 34 are held in their lower end or retracted positions by compression spring 18. The fork 12 is positioned below the lower outline level 38 of the railroad cars. This level is the plane below which the railroad car has no projections in the vicinity of the uncoupling lever. The fork 12 is positioned such that the opening 23 is disposed substantially horizontally as shown.

Figure 2:
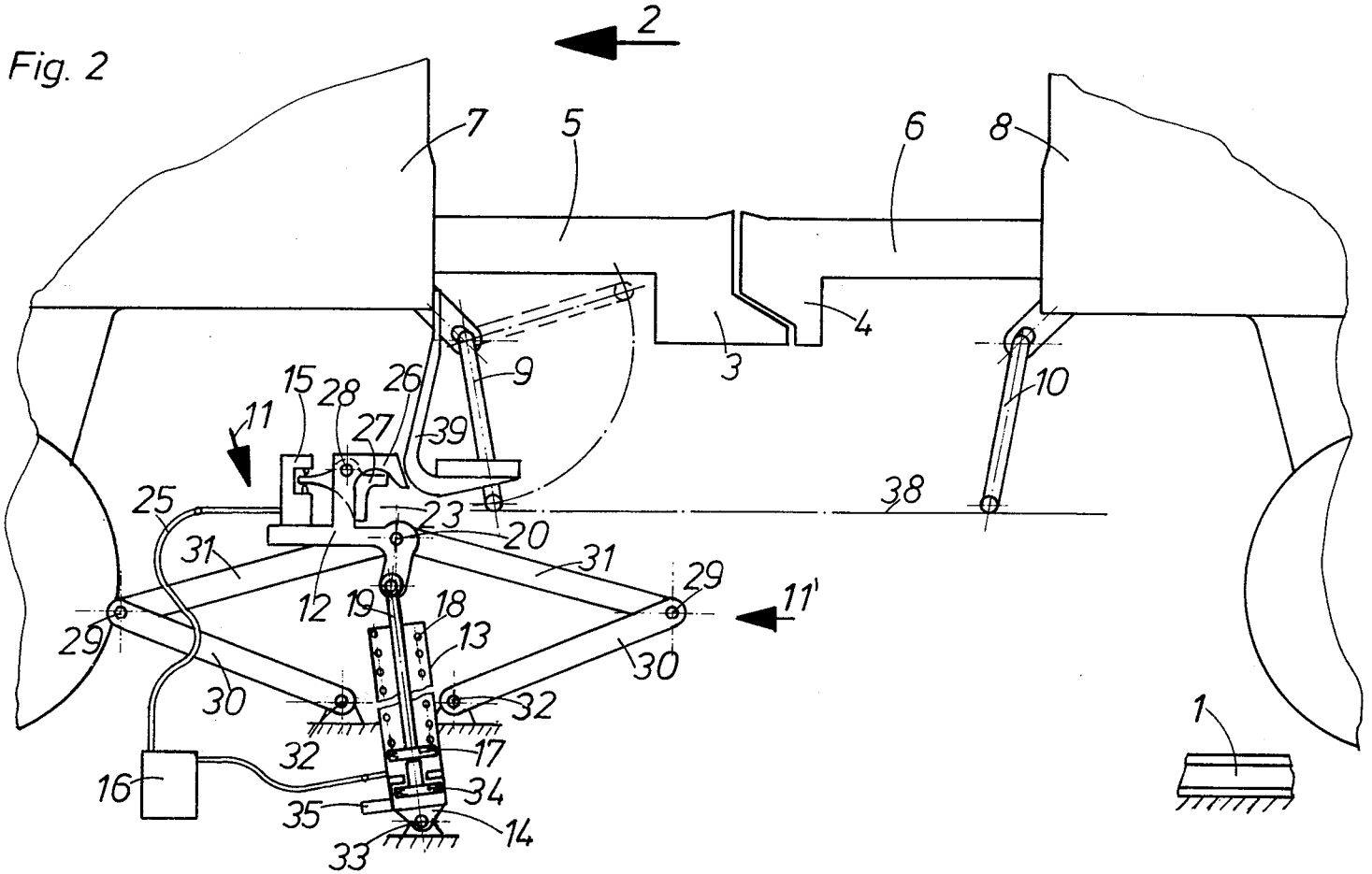
FIG. 2 is a view similar to that of FIG. 1 but showing the uncoupling device in position to intercept the uncoupling lever.

In order to initiate an uncoupling operation, the second drive cylinder 14 is subjected to a pressure medium through line 35 so that its piston 34 is displaced upwardly against the action of spring 18 into the position shown in FIG. 2. The displacement of the piston 34 will also displace the piston 17 of first cylinder 13. The operating mechanism 11 is now disposed in the position for intercepting or catching the uncoupling lever on a railroad car. The opening 23 of the hook 12 is disposed at such a level that the uncoupling lever 9 is able to enter the hook. It will be apparent that when the hook 12 is in this position the hook can be resiliently deflected and return to the upright position should its sloping nose 26 contact any projecting structure on a railroad car such as a foot board or step 39 for its supporting structure.

Figure 3:
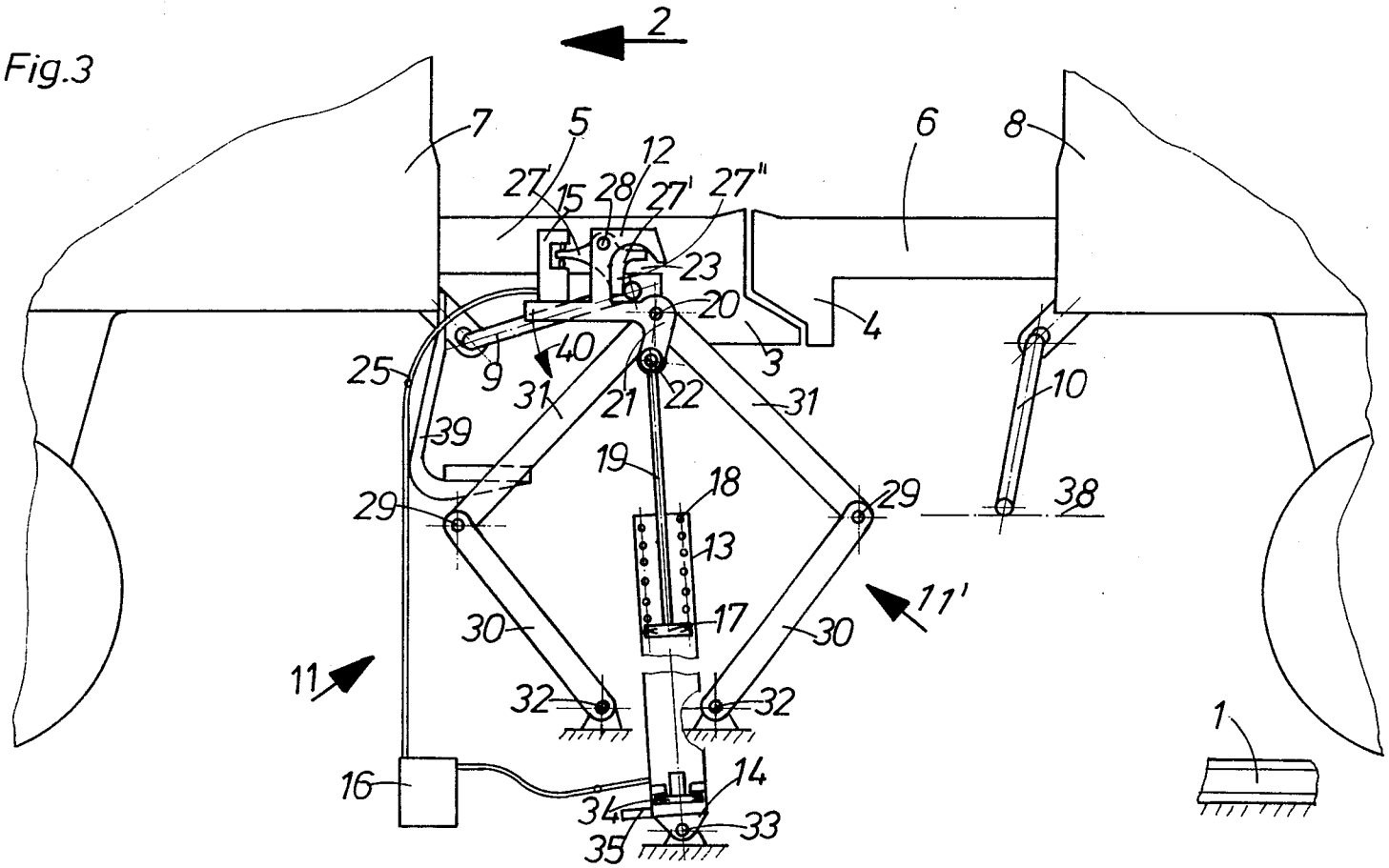
FIG. 3 is a view similar to that of FIG. 1 but showing the device in the uncoupling position.

As the uncoupling lever 9 enters the opening 23 of hook 12 and engages the switching lever 27 to pivot the switching lever, the switch 15 will be operated. As a result, fluid medium will be introduced from source 16 into the first cylinder 13 so that the piston 17 is further shifted upwardly against the force of spring 18 and the hook 12 is moved upwardly to pivot the uncoupling lever 9 into the uncoupling position as shown in FIG. 3.

Figure 4:
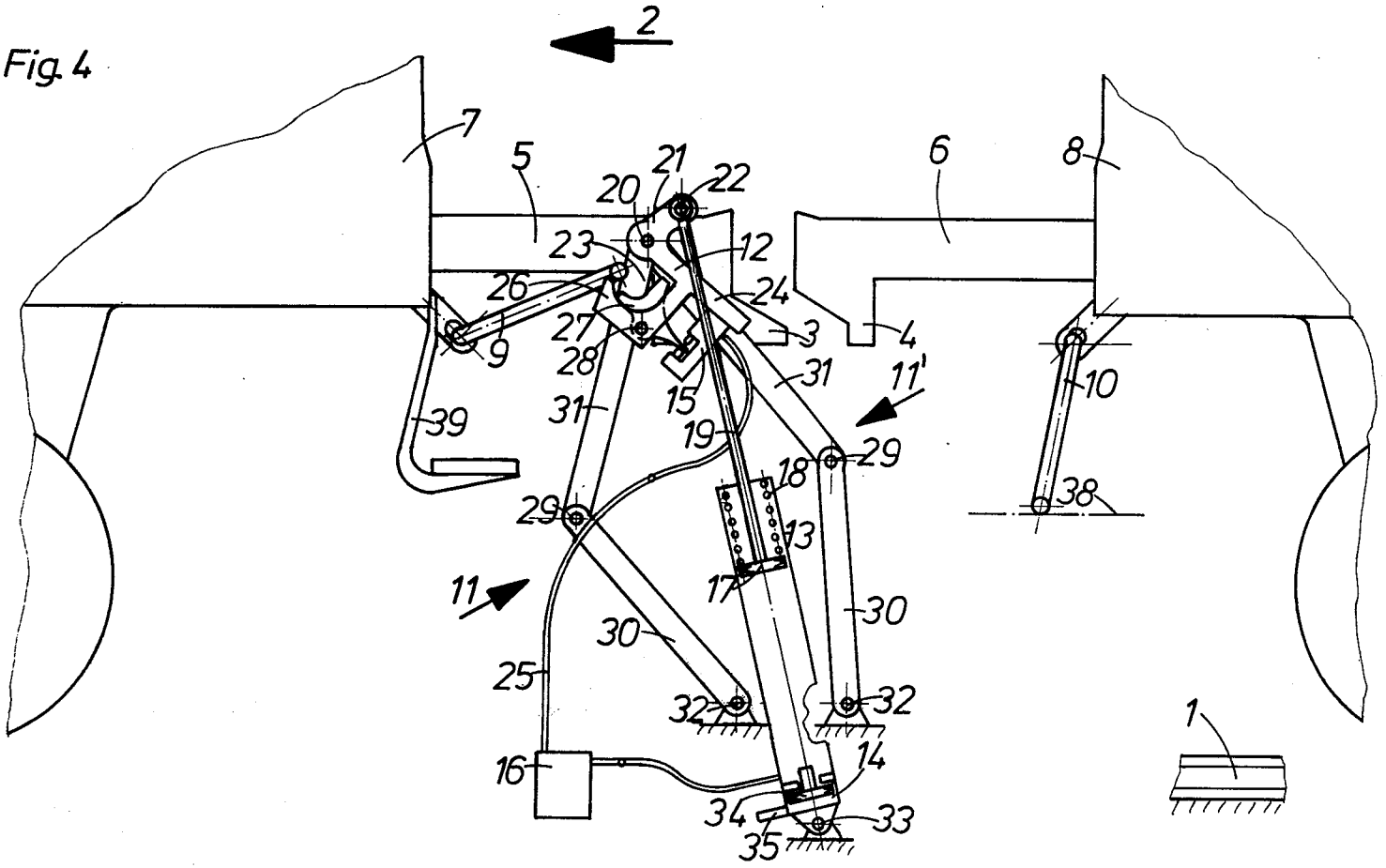
FIG. 4 is a view similar to that of FIG. 1 and showing the uncoupling device in position after completion of the uncoupling operation.

The hook 12 is then pivoted in the direction of the arrow 40 so that the uncoupling lever is free to slide out of the hook opening 23 as shown in FIG. 4. The switch 15 is again actuated by this operation which disengages the uncoupling lever from the hook to bring about the return of the operating lever into its normal position as shown in FIG. 1.

It is to be noted that during the abovedescribed sequence of operation the railroad cars 7 and 8 are moving in the direction of the arrow 2 so that the relative positions of the cars with respect to the uncoupling device will change. However, this movement of the cars will not deter the operation of the uncoupling device.

Figure 5:
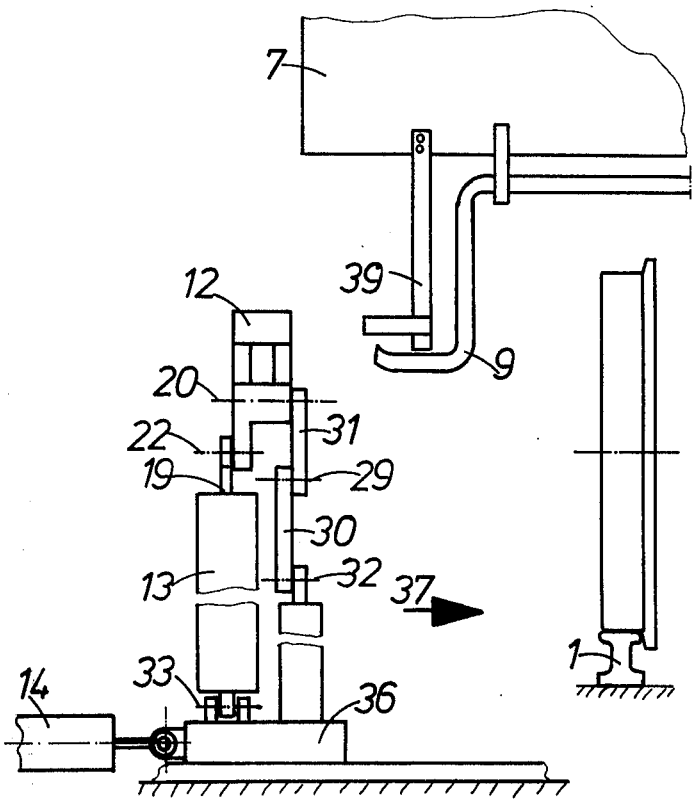
FIG. 5 is a front elevational view of a modification of the structure illustrated in FIGS. 1–4.

In the structure of FIG. 5, the linkage 11' and the first drive cylinder 13 are mounted on a carriage 36 so as to be pivotable about the pins 32 and 33 as described above. The carriage 36 can be displaced transversely with respect to the rails 1 by means of the second drive cylinder 14. The structure is illustrated in its normal or inoperative position in FIG. 5. The uncoupling device is moved to its intercepting position by displacing the carriage 36 in the direction of the arrow 37.

The sequence of operations as is described for FIGS. 1–4 is the same for the uncoupling device of FIG. 5 with the exception that at the beginning of an uncoupling operation the second drive cylinder 14 initially shifts the carriage 36 in the direction of the arrow 37 and upon completion of the uncoupling operation the carriage 36 is shifted in the reverse direction upon the second actuation of the switch 15. Thus, in the structure of FIG. 5, the hook 12 is maintained at the same level by the cylinder 13 both in its inoperative position and in its intercepting position.

While the operating mechanism has been disclosed as being provided with two pairs of interconnected arms 31 and 30 only one half of the linkage 11 may be employed so that a single arm 30 and single arm 31 which are pivotally interconnected to each other is employed.

Thus it can be seen that the present invention has described a stationary uncoupling device which is not only capable of reliably uncoupling moving railroad cars but whose operation will not be adversely affected by any structure which may project from the railroad cars in the vicinity of the uncoupling lever.

It will be understood that this invention is susceptible to modification in order to adapt it to different usages and conditions, and accordingly, it is desired to comprehend such modifications within this invention as may fall within the scope of appended claims.

What is claimed is:

1. An uncoupling device for a central buffer coupling on a railroad vehicle having an uncoupling lever pivotable about a horizontal axis transverse to the longitudinal axis of the vehicle, and comprising an operating mechanism adjacent the rails upon which the railroad vehicle is positioned and having one portion thereof pivotally mounted about a horizontal axis transverse to the longitudinal axis of the vehicle and movable between an inoperative position and an uncoupling lever engaging position, a hook pivotally mounted on another portion of said operating mechanism to engage the uncoupling lever, drive means connected to said operating mechanism for moving said operating mechanism between said inoperative and engaging positions, and switch means responsive to the engaging of the uncoupling lever within said hook for initiating movement of said operating mechanism from the engaging position to an uncoupling position.

2. An uncoupling device as claimed in claim 1 wherein said operating mechanism comprises linkage means movable in a plane perpendicular to the rails upon which the vehicle is positioned, said drive means comprising a cylinder and piston therein having a piston rod pivotally connected to said hook and movable in a plane parallel to said first plane, and spring means acting upon said piston rod to maintain said hook in a substantially horizontal position.

3. An uncoupling device as claimed in claim 2 wherein said linkage means comprises first and second pivotally connected levers.

4. An uncoupling device as claimed in claim 2 wherein said linkage means comprises a pair of first and second pivotally connected levers.

5. An uncoupling device as claimed in claim 1 wherein said switch means is mounted on said hook.

6. An uncoupling device as claimed in claim 5 wherein said hook has an extension in the direction away from the hook opening, said switch means being mounted on said extension, and a switching lever pivotally mounted on said hook and having a first arm extending into the hook opening and a second arm actuating said switch means.

7. An uncoupling device as claimed in claim 6 wherein said switching lever is T-shaped and has a stem at the junction between said first and second arms, said stem being pivotally mounted on said hook, said stem and said first arm extending into the hook opening so as to be engageable by the uncoupling lever.

8. An uncoupling device as claimed in claim 1 wherein the upper portion of said hook has a sloping nose to pivot said hook when said sloping nose engages a projection on the railway vehicle.

9. An uncoupling device as claimed in claim 1 wherein said switch means has means actuatable by each uncoupling operation for returning said operating mechanism to its inoperative position.

10. An uncoupling device as claimed in claim 1 and second drive means for moving said operating mechanism from its inoperative position to its engaging position.

11. An uncoupling device as claimed in claim 10 wherein said drive means comprises a first cylinder and a first piston therein, said second drive means comprises a second cylinder coaxial to said first cylinder and having a second piston engaging said first piston.

12. An uncoupling device as claimed in claim 10 and further comprising a carriage movable transversely to the rails and being displaceable by said second drive means, said operating mechanism being mounted on said carriage.

* * * * *